US007017887B1

(12) United States Patent
Verakis

(10) Patent No.: US 7,017,887 B1
(45) Date of Patent: Mar. 28, 2006

(54) WINCH FOR BOAT TRAILER

(75) Inventor: David C. Verakis, Florence, KY (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 0 days.

(21) Appl. No.: 10/996,295

(22) Filed: Nov. 22, 2004

(51) Int. Cl.
*B66D 1/14* (2006.01)

(52) U.S. Cl. ..... 254/342; 475/209; 475/223

(58) Field of Classification Search ..... 254/342, 254/344–346; 475/218, 209, 223
See application file for complete search history.

(56) References Cited

U.S. PATENT DOCUMENTS 4,823,639 A * 4/1989 Krause et al. ..... 74/360
4,846,009 A * 7/1989 Paluska, Jr. ..... 74/331
6,244,564 B1 * 6/2001 Noritake ..... 251/129.11
6,327,922 B1 * 12/2001 Hewatt ..... 74/5 R
6,502,472 B1 * 1/2003 Hewatt ..... 74/5 R
2002/0017150 A1 * 2/2002 Hewatt ..... 74/64

* cited by examiner

*Primary Examiner*—Emmanuel Marcelo
(74) *Attorney, Agent, or Firm*—Dorsey & Whitney LLP

(57) ABSTRACT

A low-amp winch for use on boat trailers is provided with a higher gear reduction than conventional winches and with a winch cable made of a softer material and shorter length than conventional boat winches to reduce the current draw from the motor. The winch is capable of operating off a seven-pin RV socket which provides 12 volts of DC power at no greater than 30 amps.

10 Claims, 7 Drawing Sheets

WINCH FOR BOAT TRAILER

BACKGROUND OF THE INVENTION

1. Field of the Invention

The present invention relates generally to boat trailers and particularly to a winch for a boat trailer that can be operated off a seven pin RV outlet commonly found on tow vehicles. The winch draws fewer than 30 amps off a 12-volt DC power source and does therefore not have to be connected directly to the 12-volt battery of a tow vehicle for operation. The current draw of the winch has been lowered by improving the gear ratio from the motor to the spool of the winch, by utilizing a softer cable and shortening the length of the cable.

2. Description of the Relevant Art

Many boaters do not leave their boats in a body of water but rather launch and retrieve the boat every time it is used. The boats are hauled to and from a body of water with a tow vehicle having a conventional trailer hitch to which the boat trailer can be releasably mounted. Most tow vehicles have 30-amp outlet plugs commonly referred to as seven-pin RV outlets mounted on their bumper or near the rear of the tow vehicle so that while towing the vehicle, an electrical cord can be connected thereto for operation of the trailer lights, brakes, and a battery charging circuit.

Electric trailer winches, which are desirable to assist a user in retrieving and launching a boat from the boat trailer, have typically required 12-volt DC power sources and accordingly are typically driven directly from the battery of the towing vehicle. The current drawn by a conventional winch is typically far in excess of the 30-amp max obtainable from the seven-pin RV outlets which include fuses to prevent a current greater than 30 amps from being drawn through the outlet. To deliver the power from the battery of the tow vehicle to the rear of the tow vehicle typically requires the installation of a separate wiring harness whereby the winch can be operated directly from the 12-volt battery of the tow vehicle. The process of installing such a wiring harness is often difficult and requires stringing of up to 20 feet of electrical conduit from the front to the rear of the vehicle. Additionally, the wiring harness must be secured to the frame of the vehicle and kept clear of sources of heat, like the exhaust system and any rotating components such as are found in the drive or suspension system of the tow vehicle. Because the wiring harness is installed to the tow vehicle frame, it is also exposed to environmental elements and therefore is always suspect to corrosion.

Due to the above, electric trailer winches have not been well received in the boating industry for launching and retrieving boats from boat trailers. Many boaters find the installation of the wiring harness too difficult, or once installed, too unreliable.

It is to overcome the shortcomings of prior art boat trailer winches that the present invention has been developed.

SUMMARY OF THE INVENTION

In recent years, many new pickups and SUVs have come with a seven-pin RV socket installed in or near the trailer hitch for the vehicle. The socket provides a power outlet for trailer lights, trailer brakes, and a battery charging circuit. The battery charging circuit is fused with a 30-amp relay making it capable of safely supplying 12-volt DC power at 30 amps and under. The gauge for the wiring of the battery charging circuit is also capable of supplying 12-volt DC power at 30 amps and under. Since this socket is factory installed, there are no issues with installation or corrosion like there are with current electric trailer winch wiring harnesses as described previously.

The power winch of the present invention has been designed to operate off a seven-pin RV socket in that the winch does not draw in excess of 30 amps. To reduce the current drawn by the winch in relation to conventional winches used on boat trailers, the gearing for the winch is increased so as to obtain an acceptable work output with lower current draws, a soft cable such as polyester is used in lieu of conventional steel cables and the length of the cable is shortened.

The boat trailer winch is therefore easy to operate in that it need only be plugged into the conventional seven-pin RV outlet commonly found on tow vehicles and is therefore more desirable to boaters who launch and retrieve their boats from boat trailers.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
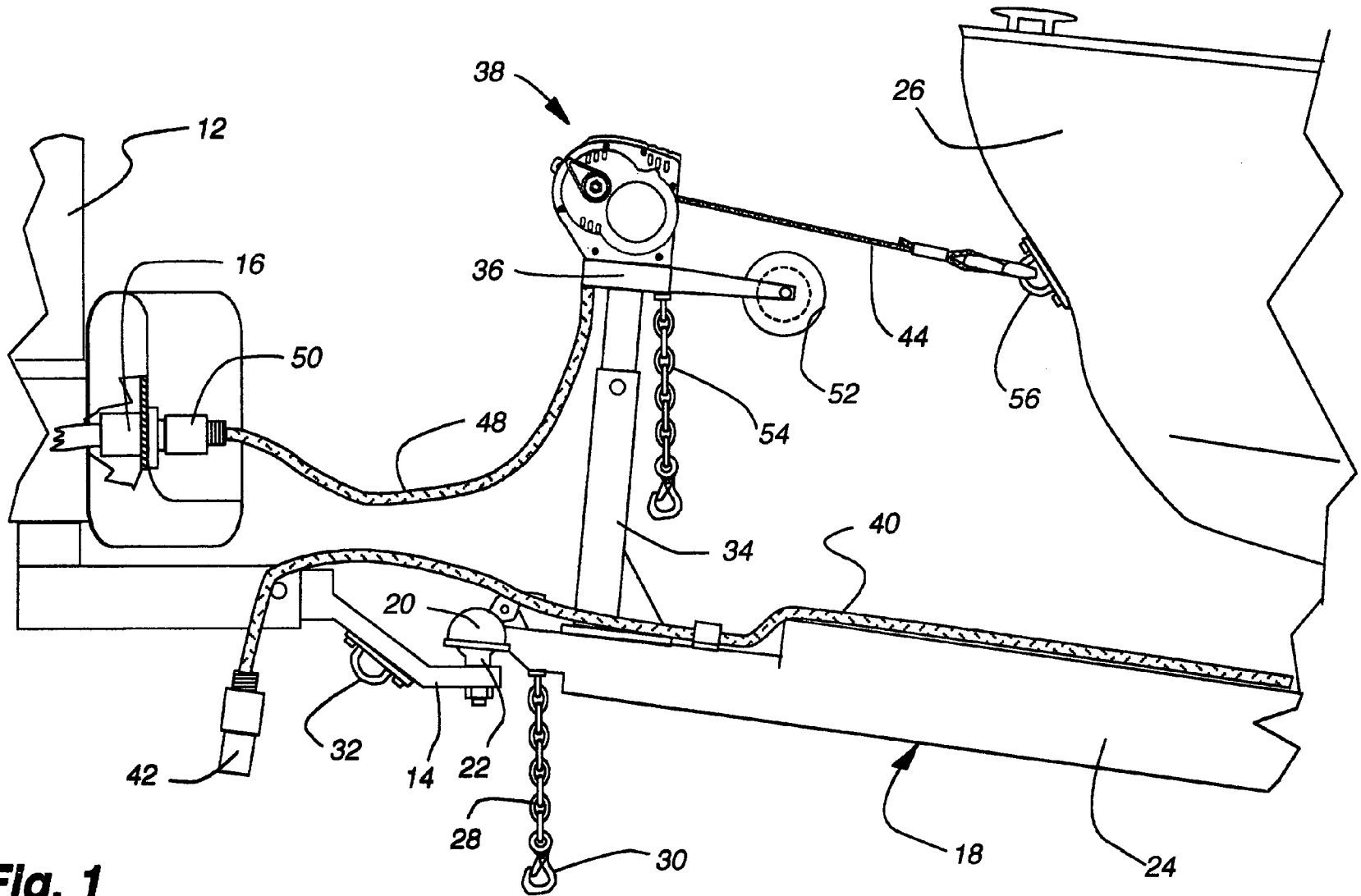
FIG. 1 is a fragmentary side elevation of a tow vehicle connected with a boat trailer having the winch of the present invention incorporated therein and with the boat partially retracted onto the trailer.
Figure 2:
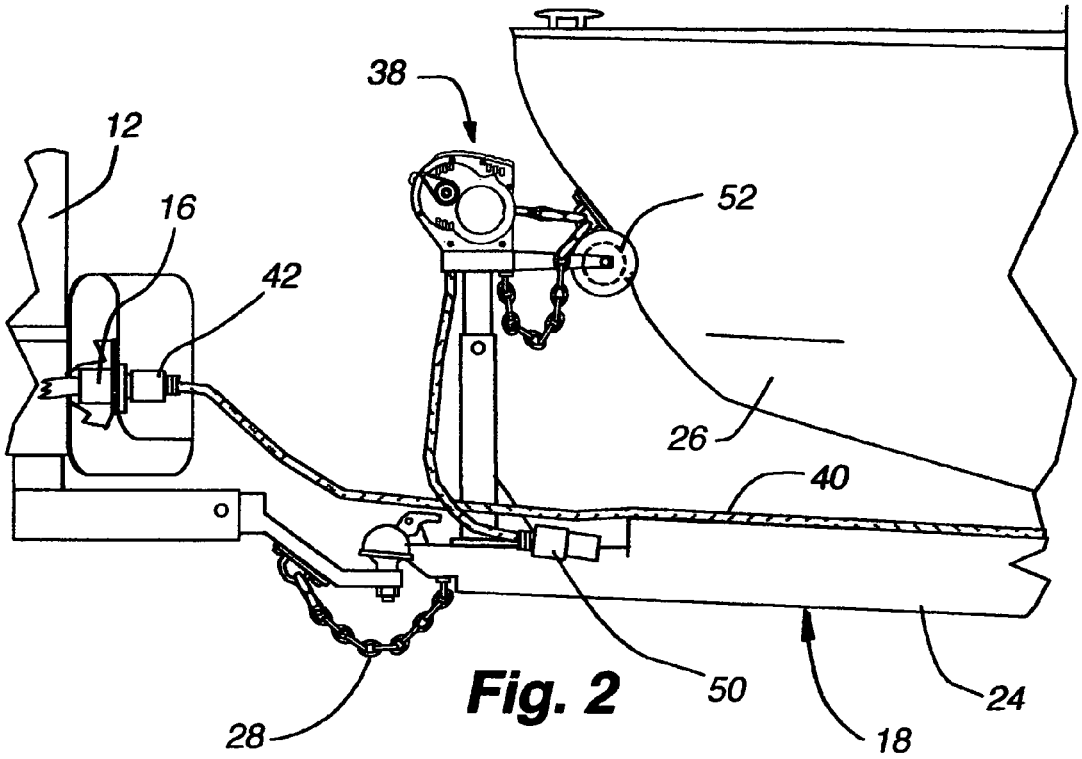
FIG. 2 is a fragmentary side elevation similar to FIG. 1 with the boat fully retracted onto the trailer.

Looking first at FIGS. 1 and 2, the rear end of a tow vehicle 12 is shown having a ball-type trailer hitch 14 mounted on its rear bumper with a seven-pin RV socket 16 also mounted on the vehicle adjacent to the rear bumper. A boat trailer 18 is shown having a conventional socket 20 for releasable attachment to the ball 22 of the trailer hitch 14 and a rearwardly extending frame 24 on which a boat 26 is conventionally supported. A safety chain 28 is mounted on the forward end of the trailer frame with a releasable clasp 30 for connection to a bracket 32 on the trailer hitch of the tow vehicle. Adjacent to the front end of the trailer, a vertically adjustable stanchion 34 is securely mounted to the trailer frame having a mounting plate 36 at its upper end for attachment to the winch 38 of the present invention.

The trailer 18 further has electrical conduit 40 with a seven-pin plug 42 adapted to be releasably insertable in the seven-pin RV socket 16 provided on the tow vehicle 12. When the tow vehicle is pulling the trailer, the seven-pin RV plug 42 on the trailer is inserted into the seven-pin RV socket 16 to provide low current power to the brake lights, brakes, and battery-charging circuit conventionally found on boat trailers. The seven-pin RV socket on the tow vehicle is conventionally connected to the 12-volt battery (not shown) of the tow vehicle and includes a 30-amp relay to render the socket capable of supplying 12-volt DC power at 30 amps or under.

As will be described in more detail later, the winch 38 of the present invention has a retractable lift cable 44, a motor 46, and electrical conduit 48 from the motor also having a seven-pin RV plug 50 on its end for releasable insertion into the seven-pin RV socket 16 on the tow vehicle. Obviously, the plug on the conduit 48 from the winch only needs to be inserted into the RV socket when the trailer plug 42 is not in the socket as when the tow vehicle is stationary and the boat is either being launched from the trailer or retrieved onto the trailer. FIG. 1 shows the boat nearly fully retrieved onto the trailer with FIG. 2 showing full retrieval of the boat so that the front end of the boat is engaged with an abutment roller 52 also mounted on the stanchion 34. A safety chain 54 also connects the stanchion to a bracket 56 on the front of the boat during transport of the boat on the trailer.

Figure 3:
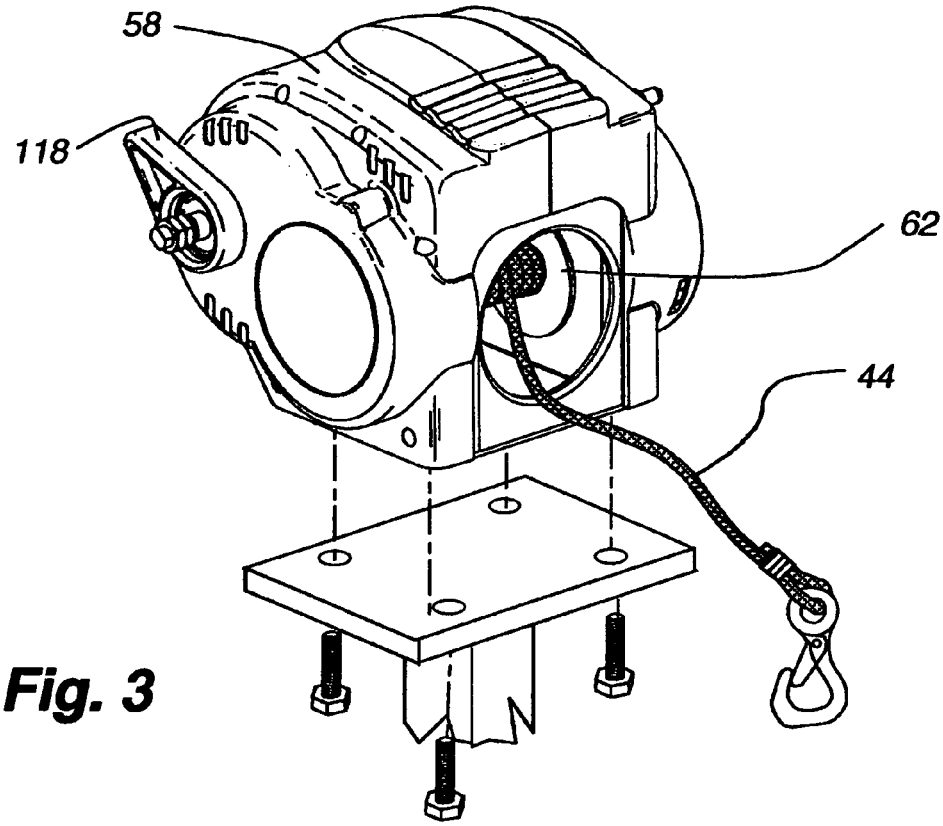
FIG. 3 is a fragmentary isometric showing the winch of the present invention.
Figure 4:
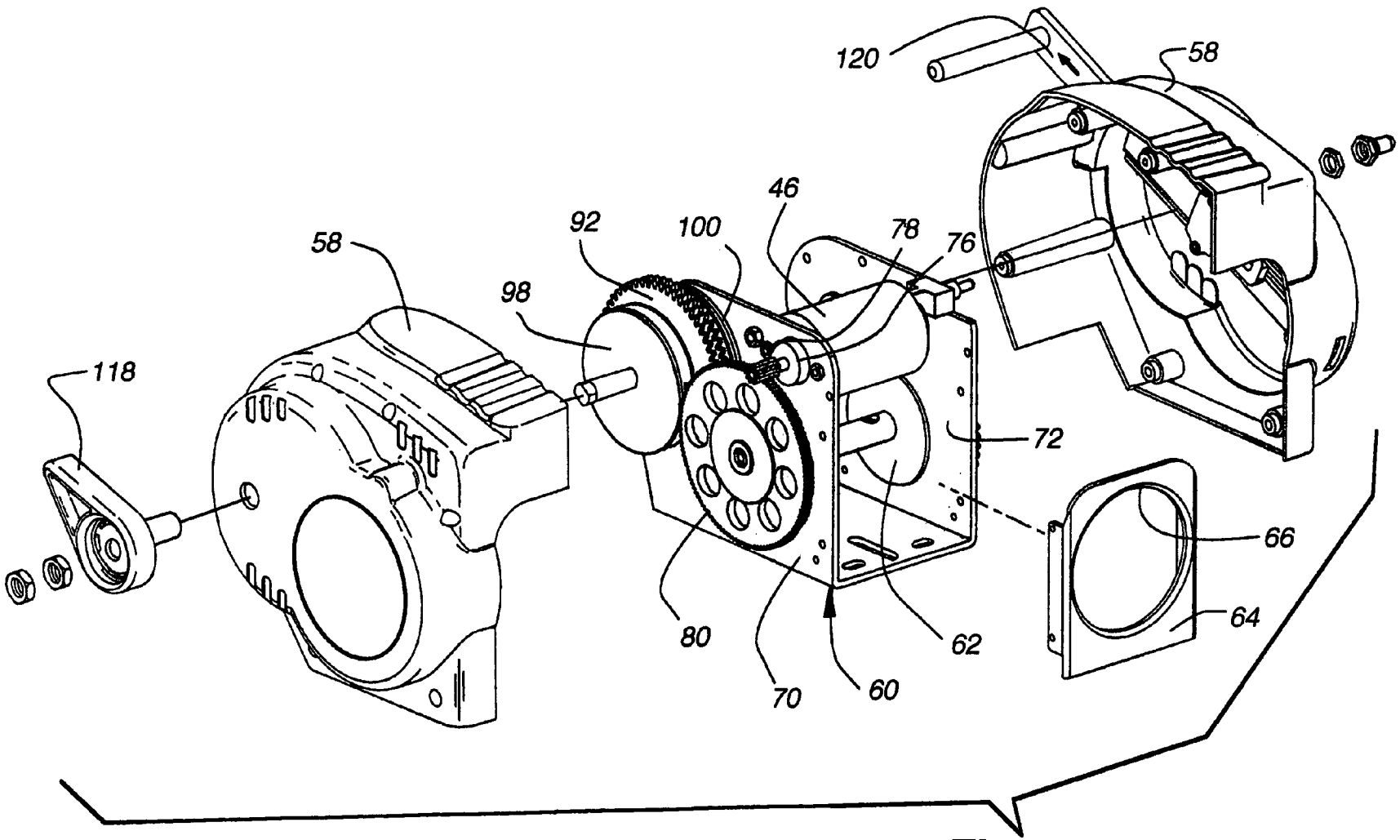
FIG. 4 is an exploded isometric of the winch of the present invention.

The winch 38 is probably best seen in FIGS. 3 and 4 to include a two-piece housing 58 adapted to be secured in surrounding relationship with a U-shaped frame 60 on which the electrical motor 46, gearing, and a spool 62 for the lift cable 44 are mounted. A closure plate 64 with a circular cable access opening 66 is mountable on the U-shaped frame at the front of the winch so that the cable is free to extend or retract during operation of the winch. The cable of course has a releasable clasp 68 on its free end for attachment to the bracket 56 on the front of the boat during launching or retrieving of the boat.

Figure 5:
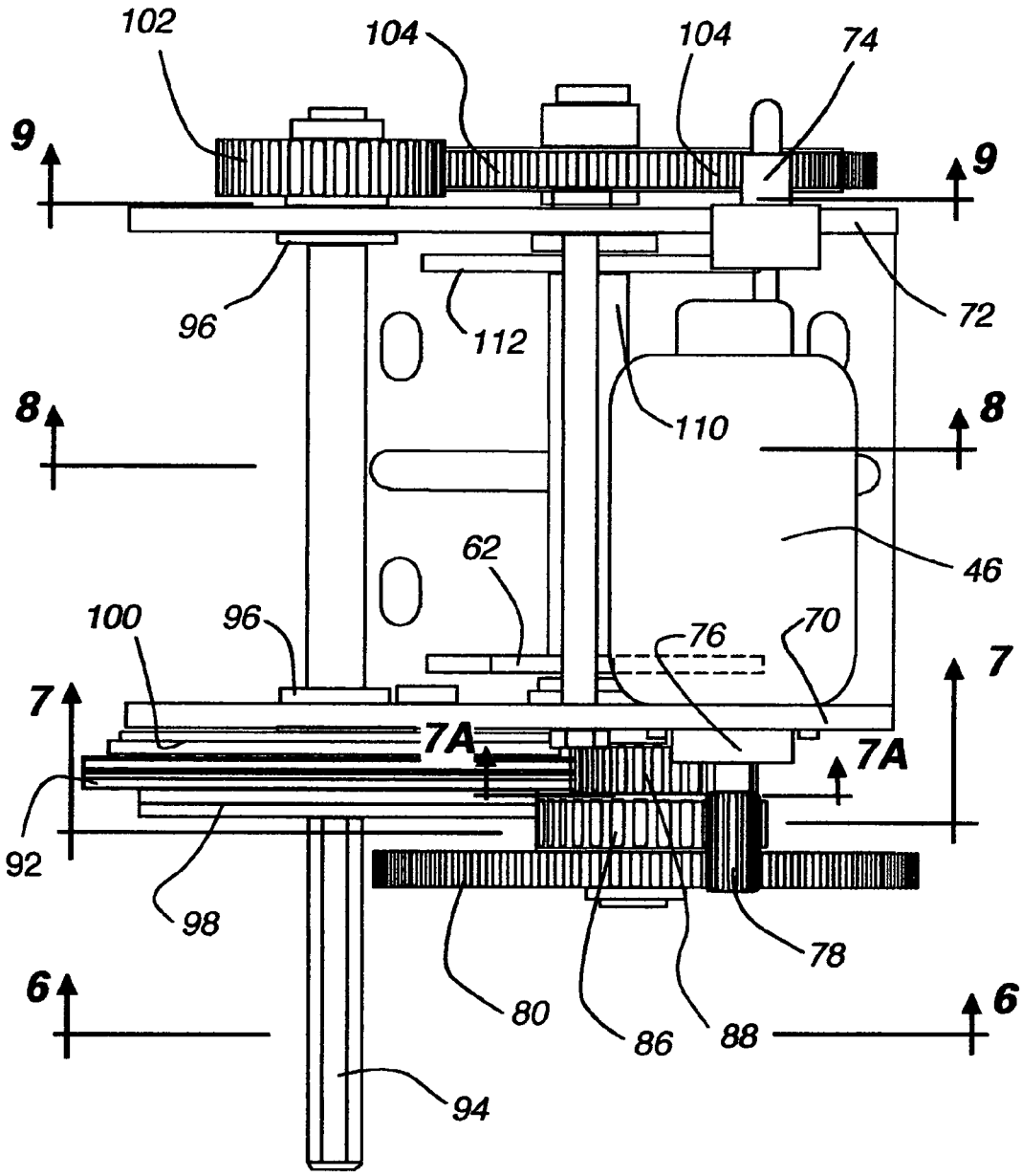
FIG. 5 is a top plan view of the operating components of the winch of the present invention.
Figure 6:
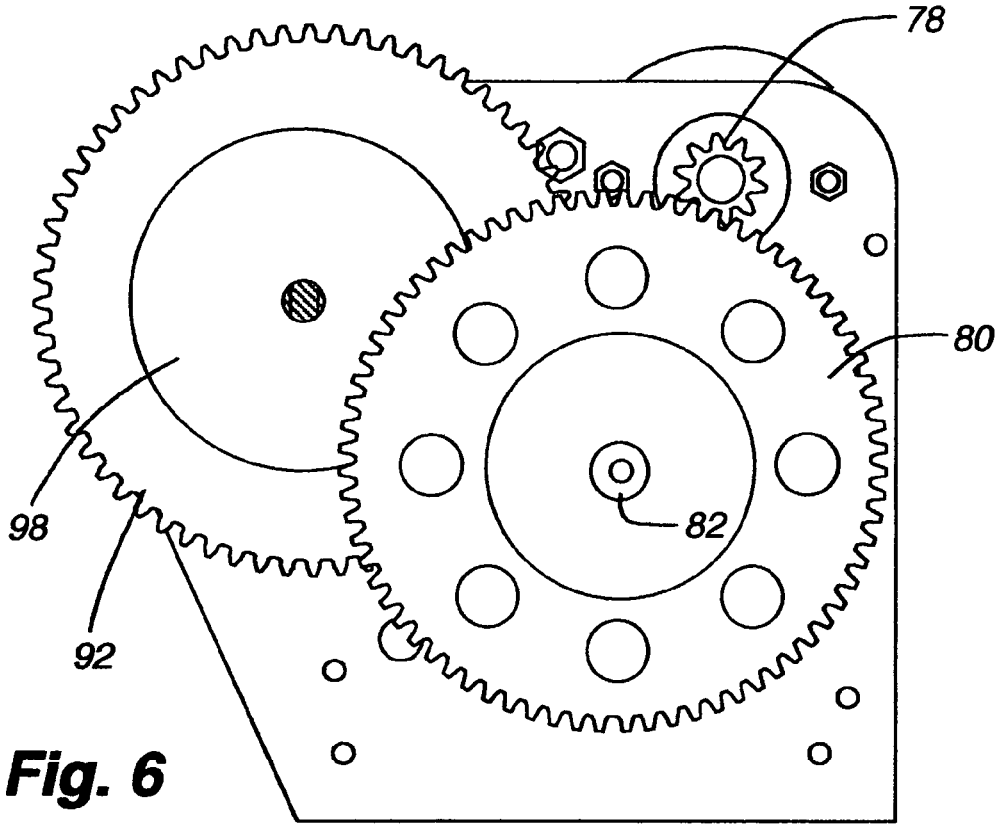
FIG. 6 is a section taken along line 6—6 of FIG. 5.
Figure 7:
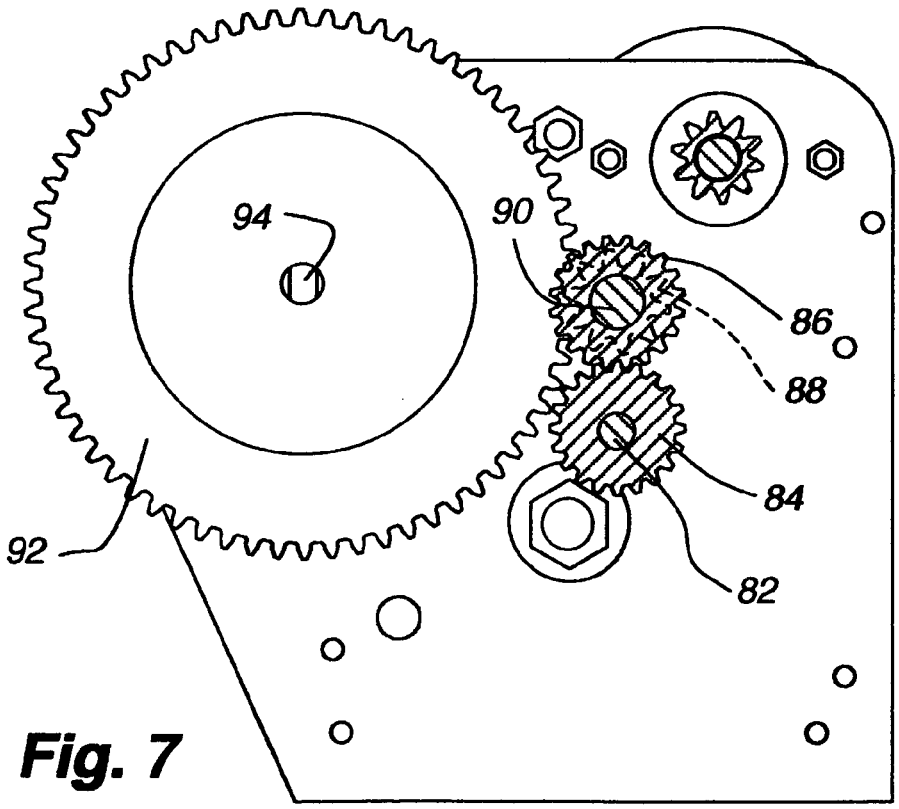
FIG. 7 is a section taken along line 7—7 of FIG. 5.
Figure 8:
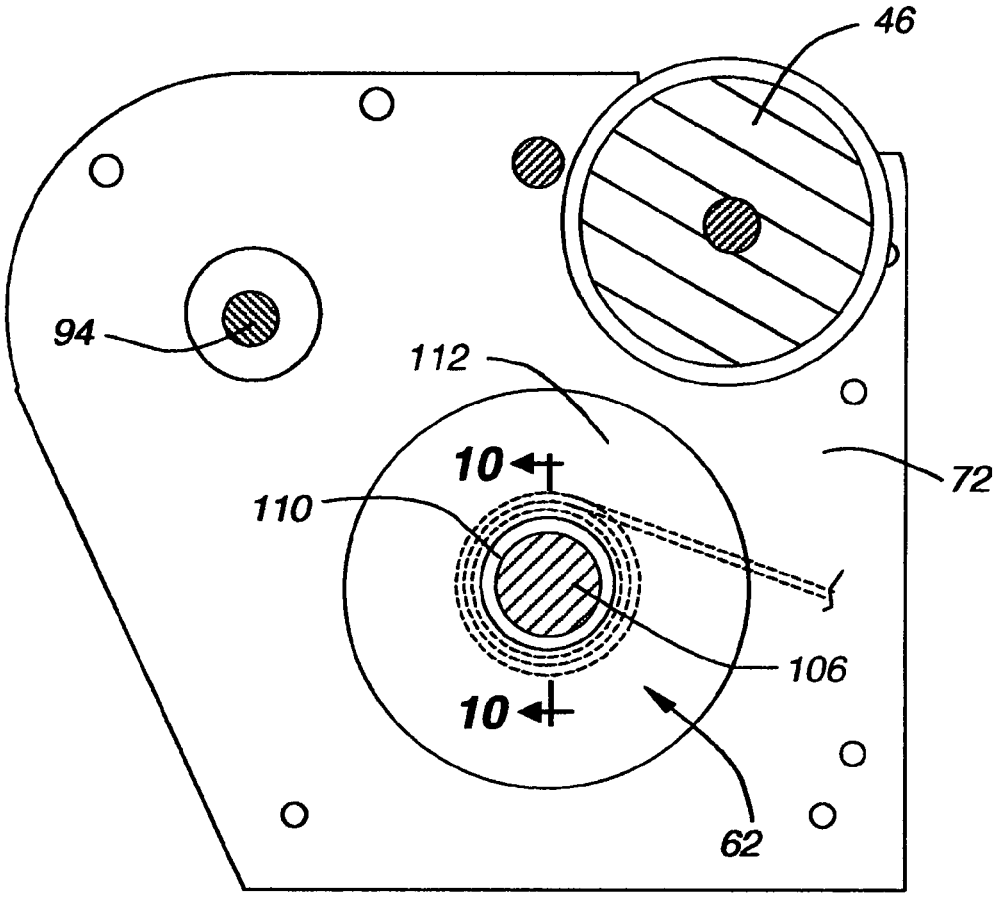
FIG. 8 is a section taken along line 8—8 of FIG. 5.
Figure 7A:
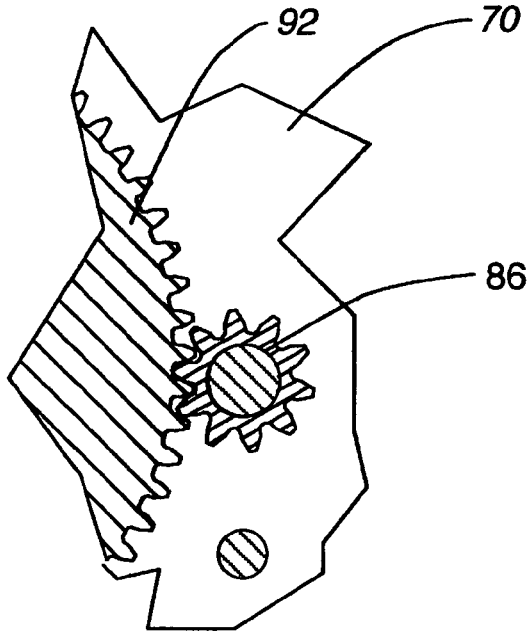
FIG. 7*a* is a fragmentary section taken along line 7*a*—7*a* of FIG. 5.
Figure 9:
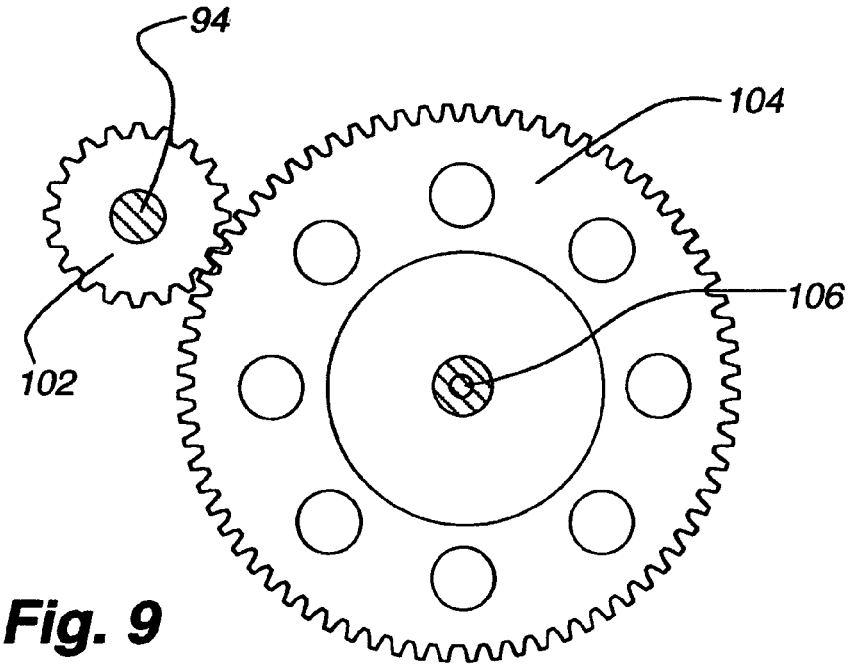
FIG. 9 is a section taken along line 9—9 of FIG. 5.

With more specific reference to FIGS. 4–9, the drive system for the winch 38 is illustrated wherein the electric motor 46 is seen mounted near the upper front of the frame 60 so as to bridge the space between left 70 and right 72 upstanding side walls of the frame. The motor is a one-way motor with an on/off switch 74 for operation. The switch extends through the right side wall of the frame for ready access by an operator. The drive shaft from the motor extends through a bearing 76 in the left side wall of the frame and has a first gear 78 thereon meshed with a relatively large diameter second gear 80 which is in turn rotatably mounted on a shaft 82 on the left side wall 70. As best seen in FIGS. 5 and 7, the second gear has a relatively smaller third gear 84 secured to its inner surface for unitary rotation therewith. This third gear is hidden from view in FIG. 5 but can be seen in FIG. 7. The third gear is meshed with a rotatably mounted fourth gear 86 immediately thereabove and spaced inwardly from the second gear 80. The fourth gear may be similar in size to the third gear but it could be larger if desired. The fourth gear is part of a gear pair with a fifth gear 88 that is mounted for unitary rotation therewith on a shaft 90 mounted on a bearing in the left side wall as well. The fifth gear 88 is aligned and meshed with a relatively large sixth gear 92. The sixth gear is rotatably mounted on a transfer shaft 94 that is splined or keyed at its left end and that rotates freely in bearings 96 in the left and right side walls with the transfer shaft extending outwardly from both the left and side walls. This sixth gear rotates freely about the transfer shaft and is engageable on opposite faces with clutch plates 98 and 100 which can selectively engage the associated faces of the sixth gear to selectively rotatably drive the sixth gear or can be disengaged to allow the sixth gear to rotate freely about the transfer shaft. Operation of the clutch plates will be described in more detail hereafter.

Figure 10:
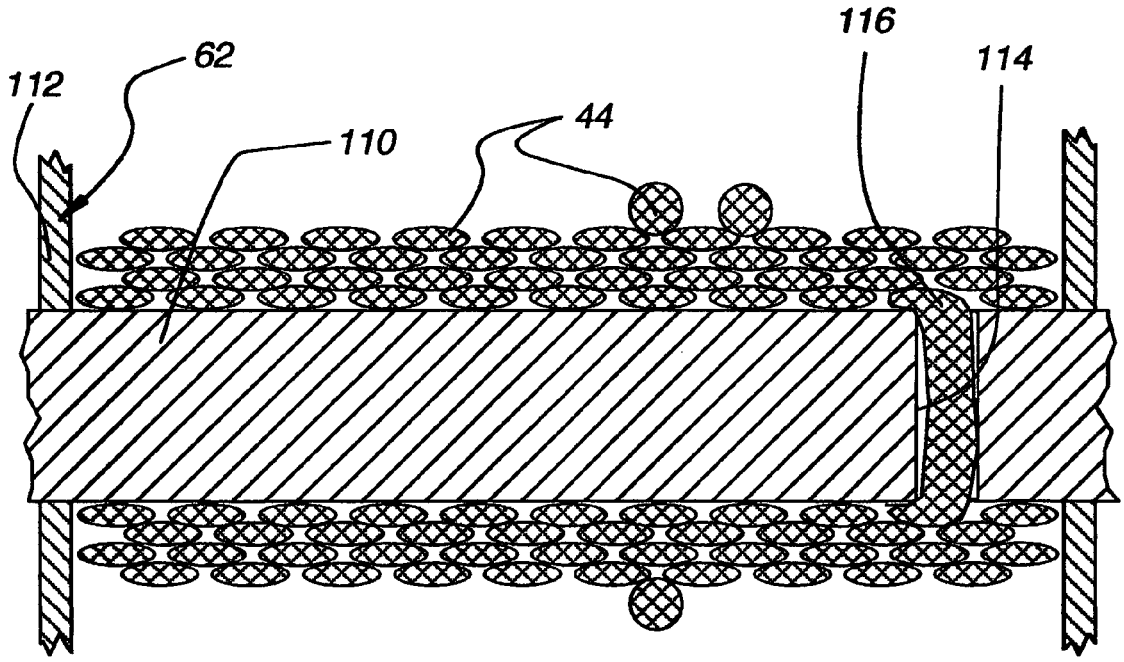
FIG. 10 is an enlarged fragmentary section taken along line 10—10 of FIG. 8.

The opposite end of the transfer shaft 94 which projects away from the outside surface of the right side wall 72 has a seventh gear 102 mounted thereon of a relatively small diameter in relation to the sixth gear 92. The seventh gear, as possibly seen best in FIGS. 5 and 9, engages and is meshed with a relatively large spool or eighth gear 104 which is fixed to a transverse shaft 106 journaled in the left and right side walls of the frame 60 for rotation with the eighth gear. The spool 62, as best seen in FIGS. 4, 5, and 10, is mounted on the transverse shaft 106 for unitary rotation therewith and has a cylindrical horizontal body 110 with end flanges 112 so that the winch cable 44 can be wrapped thereabout. As best appreciated by reference to FIG. 10, the cylindrical body of the spool has a transverse passage 114 therethrough for anchoring one end 116 of the winch cable.

From the above, it will be appreciated when the clutch is engaged, rotary motion from the drive motor 46 causes the gears to transfer power from one to another and finally to the take-up spool 62 for wrapping the winch cable onto the spool. The gear ratio from the output of the electric motor to the take-up spool is approximately 355:1 as opposed to gear ratios of approximately 270:1 used on conventional boat trailer winches.

The clutch is a conventional clutch system with a pivotal handle 118 as seen in FIG. 4 mounted on the splined or keyed transfer shaft 94 such that rotation of the handle in one direction causes the closest clutch plate 98 to advance against the sixth gear 92 forcing it against the opposing clutch plate 100 on the opposite side. Rotation of the sixth gear caused from the first five gears in the gear train is transferred to the clutch plates and consequently through the transfer shaft 94 to the seventh gear 102 on the right side wall of the frame. Of course, rotation of the seventh gear causes rotation of the eighth gear and subsequently the spool 62 at a speed ratio of 355:1, as mentioned previously. Conversely, when the clutch handle is pivoted in an opposite direction, the clutch plate 98 is allowed to retract from engagement with the sixth gear allowing the sixth gear to rotate freely about the transfer shaft so that rotation from the output shaft of the motor does not get transferred to the take-up spool.

In achieving the desired low current draw for operation of the winch 38 from a 30-amp circuit, the load not only has to be reduced through the gearing but it is also desirable that the length of winch cable 44 is not excessive and it has been found that a winch cable of approximately 10–12 feet in length, preferably 11 feet, can be used in lieu of conventional winch cables of approximately 20 feet in length. Further, while conventional winch cables are incompressible galvanized steel cable of one-inch diameter, it has been found useful to utilize a softer and lighter cable of one-fourth inch diameter so that the cable remains relatively compact with the spool 108 thereby minimizing leverage and power drain on the motor. A high molecular weight polyethylene rope or cable has been found suitable for the above purposes and with reference to FIG. 10, it will be appreciated that as such a cable is wrapped onto the spool, it will compress from its normal circular transverse cross-sectional configuration to a flattened ovular configuration thereby keeping at a minimum the depth of wrapped cable on the spool.

By structuring the winch as described, the maximum dead lift rating of the winch has been reduced from a conventional 1500 pounds to 800 pounds. This reduction in rating, of course, leads to lower current draw by the winch as desired.

Another advantage in the winch of the present invention results from the fact that it does not require a levelwind plate (not shown) commonly found on conventional boat trailer winches wherein the levelwind plate is positioned adjacent to the wrapped cable on the spool to prevent the cable from bunching up on one side of the spool. The levelwind plate engages the cable thus increasing the amount of drag on the winch mechanism and thus increasing the current draw by the winch motor. In the present invention, a level wind plate is not required as the softer cable is flexible and does not bunch on the spool.

In order to lock and prevent the winch from counter-rotating, a conventional ratchet-pawl type lock (not shown) can be utilized. The pawl would be mounted adjacent to the sixth gear to allow the pawl to rest in engagement with the gear teeth on the sixth gear so as to allow rotation of the sixth gear in one direction but not in the reverse direction.

Further, as seen in FIG. 4, a manually operable handle 120 for operating the winch in case of a failure in the power driven mode is stored in the housing. The handle can be removed from the housing and placed on the end of the transfer shaft in lieu of the clutch handle and rotated to manually rotate the spool.

In the preferred embodiment, the designated gears in the winch have pitch diameters as set forth in the following table:

| Gear # | Pitch Diameter |
|---|---|
| 1 | .4166 |
| 2 | 5.000 |
| 3 | .667 |
| 4 | 1.750 |
| 5 | 1.000 |
| 6 | 4.750 |
| 7 | 2.000 |
| 8 | 4.750 |

The winch as aforedescribed has been found to require only approximately 20 amps from a 12-volt DC power source and is fully suitable for use with float-on type trailers which allow a boat to be driven onto the trailer close to the winch so that the boat does not have to be dragged a significant distance across the trailer.

Although the present invention has been described with a certain degree of particularity, it is understood the present disclosure has been made by way of example and changes in detail or structure may be made without departing from the spirit of the invention as defined in the appended claims.

What is claimed is:

1. A winch for operating off a 12-volt DC power supply so as to draw fewer than 30 amps comprising in combination:

a motor having an output shaft with a first gear;

a first gear pair having a second gear for meshing with said first gear and a third gear, said second gear having a greater diameter than said first gear and said third gear having a smaller diameter than said second gear, said second and third gears being operatively interconnected to rotate in unison;

a second gear pair having a fourth gear meshed with said third gear and having a diameter at least as great as said third gear and a fifth gear of a smaller diameter than said fourth gear, said fourth and fifth gears being operatively interconnected to rotate in unison;

a sixth gear meshed with said fifth gear, said sixth gear having a greater diameter than said fifth gear;

a seventh gear having a smaller diameter than said sixth gear and adapted to be rotated in unison with said sixth gear;

an eighth gear meshed with said seventh gear and having a diameter greater than said seventh gear;

a spool operatively connected to said eighth gear to rotate in unison therewith; and a compressible, flexible cable made of a synthetic material having one end anchored to said spool, said cable being wrappable about said spool upon energization of said motor.

2. The winch of claim 1 wherein the gear ratio between said output shaft of said motor to said spool is approximately 355:1.

3. The winch of claim 2 wherein the length of said cable is in the range of 10 to 12 feet.

4. The winch of claim 1 wherein the length of said cable is in the range of 10 to 12 feet.

5. The winch of claim 4 wherein the diameter of said cable is approximately one-fourth inch.

6. The winch of claim 1 wherein the diameter of said cable is approximately one-fourth inch.

7. The winch of claim 1 wherein said first gear has a pitch diameter of approximately 0.4166 inches, said second gear has a pitch diameter of approximately 5.000 inches, said third gear has a pitch diameter of approximately 0.667 inches, said fourth gear has a pitch diameter of approximately 1.750 inches, said fifth gear has a pitch diameter of approximately 4.750 inches, said seventh gear has a pitch diameter of approximately 2.000 inches, and said eighth gear has a pitch diameter of approximately 4.750 inches.

8. The winch of claim 1 wherein said motor draws fewer than 30 amps with a 12-volt power supply.

9. The winch of claim 8 wherein said motor draws approximately 20 amps with a 12-volt power supply.

10. The winch of claim 1 further including a clutch operatively associated with said sixth gear to selectively permit said sixth gear to transfer rotation to said seventh gear.

* * * * *